US009259960B1

(12) United States Patent
Tepsi et al.

(10) Patent No.: US 9,259,960 B1
(45) Date of Patent: Feb. 16, 2016

(54) PAINT CAN ASSEMBLY

(71) Applicants: Johnny Tepsi, La Verne, CA (US); Fadi Tepsi, La Verne, CA (US)

(72) Inventors: Johnny Tepsi, La Verne, CA (US); Fadi Tepsi, La Verne, CA (US)

( * ) Notice: Subject to any disclaimer, the term of this patent is extended or adjusted under 35 U.S.C. 154(b) by 20 days.

(21) Appl. No.: 14/476,517

(22) Filed: Sep. 3, 2014

(51) Int. Cl.

| | |
|---|---|
| ***B65D 25/16*** | (2006.01) |
| ***B65D 41/04*** | (2006.01) |
| ***B44D 3/12*** | (2006.01) |
| ***B65D 25/14*** | (2006.01) |
| ***B65D 43/02*** | (2006.01) |
| *B65D 90/04* | (2006.01) |

(52) U.S. Cl.
CPC *B44D 3/12* (2013.01); *B65D 25/14* (2013.01); *B65D 43/02* (2013.01); *B65D 2543/00435* (2013.01)

(58) Field of Classification Search
CPC ..... B44D 3/127; B44D 3/12; B65F 1/06; B65D 77/06; B65D 25/14; B65D 43/02; B65D 2543/00435
USPC ..... 220/495.02, 495.08, 495.1, 297
See application file for complete search history.

(56) References Cited

U.S. PATENT DOCUMENTS 1,663,570 A * 3/1928 Senz ..... B65D 39/08 220/297
1,803,847 A * 5/1931 Hartley ..... B65D 45/02 220/297
3,211,324 A * 10/1965 Sapien ..... B05B 7/2408 220/495.02
3,401,842 A 9/1968 Morrison
3,779,419 A 12/1973 Heitz
3,858,810 A 1/1975 Seeley
4,151,929 A 5/1979 Sapien
5,160,062 A * 11/1992 Strawder ..... B65F 1/06 220/495.08
5,320,241 A * 6/1994 Evans ..... B65F 1/06 220/495.08
5,460,289 A * 10/1995 Gemmell ..... B44D 3/126 220/495.02
5,816,501 A 10/1998 LoPresti
7,665,672 B2 * 2/2010 Kosmyna ..... B05B 7/2408 220/495.02
8,127,963 B2 3/2012 Gerson

* cited by examiner

*Primary Examiner* — Mickey Yu
*Assistant Examiner* — Niki Eloshway
(74) *Attorney, Agent, or Firm* — Trojan Law Offices

(57) ABSTRACT

A paint can assembly that prevents spilling and seeping of paint. The assembly includes a receptacle, a liner bag for holding the paint, a mounting ring, and a removable lid. The mounting ring has several projections along its periphery that are aligned with holes in the liner bag. The holes in liner bag are sized to fit over the projections of the mounting ring that holds the liner in place within the reservoir of the receptacle. After paint is poured into the liner bag, a lid that has slots to fit the projections of the mounting ring is placed over the projections and rotated to lock the lid to the mounting ring and receptacle, and sandwiching the liner to prevent paint from seeping out of the liner bag. The liner bag may have bulges near its top periphery that rest within recessed threading in the mounting ring.

8 Claims, 4 Drawing Sheets

PAINT CAN ASSEMBLY

CROSS-REFERENCE TO RELATED APPLICATIONS

None.

FIELD OF THE DISCLOSURE

The present invention relates to a device for holding liquids in a spill-resistant can, and more particularly to a paint can lid and liner.

BACKGROUND

There are a variety of containers used to hold paint for use with a paint spray gun. In paint cans used with brushes, the top of the paint can is left open during the painting process. But for paint cans used to hold the paint when using a spray nozzle, a lid should be secured to the can containing the paint because there is no need for the paint to be exposed during the spray process. The only opening in a paint can assembly for painting with a spray gun is a paint outlet on a lid, where a spray nozzle, or hose attached to the spray nozzle, attaches to the assembly.

A traditional paint can used during brushing is generally not meant to be reused and refilled with a different color of paint. Each paint can is meant for a single use and contains just a single paint color. However, paint can assemblies used for painting with a spray nozzle are more expensive, and the receptacle holding the paint is meant to be reused for different painting jobs. Therefore, while a traditional simple paint can does not need a liner to protect the inner surfaces of the can from direct contact with the paint, the receptacle used in spray paint assemblies need to be protected from direct contact with the paint so that different colored paints may be filled in the receptacle for different jobs. This protection of the inner surface of the receptacle often comes in the form of a deformable and disposable liner (such as a plastic bag), which is placed in the receptacle to reduce the labor required to clean the receptacle between paint jobs. In this manner, the receptacle can be reused many times. Using an inner liner to hold paint, instead of having paint directly in the receptacle, allows the user to replace the liner between jobs, instead of having to clean the receptacle between each job.

Paint cans with liner bags, and various methods to seal and lock the liner bags to a paint can are known in the art. Examples are described in U.S. Pat. No. 6,820,824 to Joseph et al., U.S. Pat. No. 3,432,104 to Kaltenbach, U.S. Pat. No. 4,151,929 to Sapien, U.S. Pat. No. 5,816,501 to Lopresti, and U.S. Pat. No. 8,127,962 to Gerson. However, many of the known liners, and locking mechanisms that seal the liner, are expensive to manufacture, do not effectively seal the contents of the can, or are difficult to use. Therefore, there remains a need for improved low cost liners and associated locking/sealing mechanisms that prevent paint from seeping out from paint can assemblies.

SUMMARY

The embodiments of the present invention are directed to a paint can assembly, but may be used for other liquid contents where it is desired that a liquid remains sealed within a container. It is an object of the present invention to provide a liner bag and lid to a paint can assembly that has all of the advantages of the prior art and at the same time limits, or all together eliminates, disadvantages of the prior art. These and other objects are accomplished using a liner bag having holes around its top periphery that fit over projections on a mounting ring that is disposed within the receptacle. This allows the liner to be placed within the receptacle while preventing the entirety of the liner from completely falling into the receptacle. The lid seals the receptacle by engaging the projections, and the lid is locked to the receptacle and mounting ring when the user rotates the lid with respect to the receptacle and mounting ring. This arrangement of the lid, mounting ring, liner, and receptacle, sandwich the liner bag between the lid and receptacle, thereby preventing paint in the liner bag from seeping out of the receptacle.

In a first embodiment, the assembly includes a receptacle, a mounting ring, a receptacle liner bag, and a removable lid. The receptacle may be a cup that has a bottom, an upper rim, and an open top. The mounting ring has a peripheral flange insertable into the cup and an upper lip adapted to be set on top of the upper rim of the receptacle. The upper lip has a plurality of protrusions extending substantially perpendicular form the upper lip. The receptacle liner bag may be collapsible and is disposed within the receptacle. The liner bag has a top region with an open end and a plurality of holes along the periphery of the top region. The holes are arranged in alignment with the plurality of protrusions on the upper lip of the mounting ring. The plurality of protrusions on the upper rim project through the plurality of holes on the liner bag. The removable lid is placed on top of the receptacle, mounting ring, and liner bag to seal the contents of the receptacle. The lid has a flange that has a plurality of slots in alignment with the plurality of protrusions on the mounting ring.

In other embodiments of the invention, the liner bag has bulges near the top region. These bulges are aligned with internal threading along the mounting ring and/or the receptacle so that the bulged region of the liner fits within the threading. This allows the liner to seal the threads and fill in gaps creates by the threading. Without the bulged regions of the liner, it would be easier for paint to seep through the threading and exit the paint can assembly.

In still further embodiments of the invention, the flange on the lip has slots that are arced. The slot has a first end and a second end. The first end of the slot has a width greater than the second end of the slot. Each of the protrusions on the mounting ring has a top region and a middle region, which are sized differently to help lock the lid to the mounting ring. The top region of the protrusion has a width greater than the middle region of the protrusion. The top region is sized to fit through the first end of the slot (which is larger), but not the second end of the slot (which is narrower). These size differences permit the protrusion to penetrate through the first end of the slot, but not the second end. After the protrusion is placed through the first end of the slot, the lid is rotated so that the protrusion extends through the second narrower end of the slot. In this position, the lid cannot be removed from the mounting ring because the large top region of the protrusion cannot vertically pass through the narrower second region of the slot. The middle region of the protrusion is sized to have a width to substantially equal to width of the second end of the slot. These size differences in the regions of each protrusion allow the protrusion to slide from the first end of the slot to the second end of the slot, and lockable engage the mounting ring after rotation. The lid is prevented from being pulled off of the mounting ring unless the lid is rotated to its original insertion position, where the wider top region of the protrusion can once again pass through the wider first region of the slot.

DETAILED DESCRIPTION OF EMBODIMENTS

In the following description, a number of embodiments and applications of the present disclosure are described. References are made to the accompanying drawings and are shown by way of illustrating specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Many of the steps are presented below in an order intended only as an exemplary embodiment. Unless logically required, no step should be assumed to be required earlier in the process than a later step simply because it is written first in this description.

Figure 1:
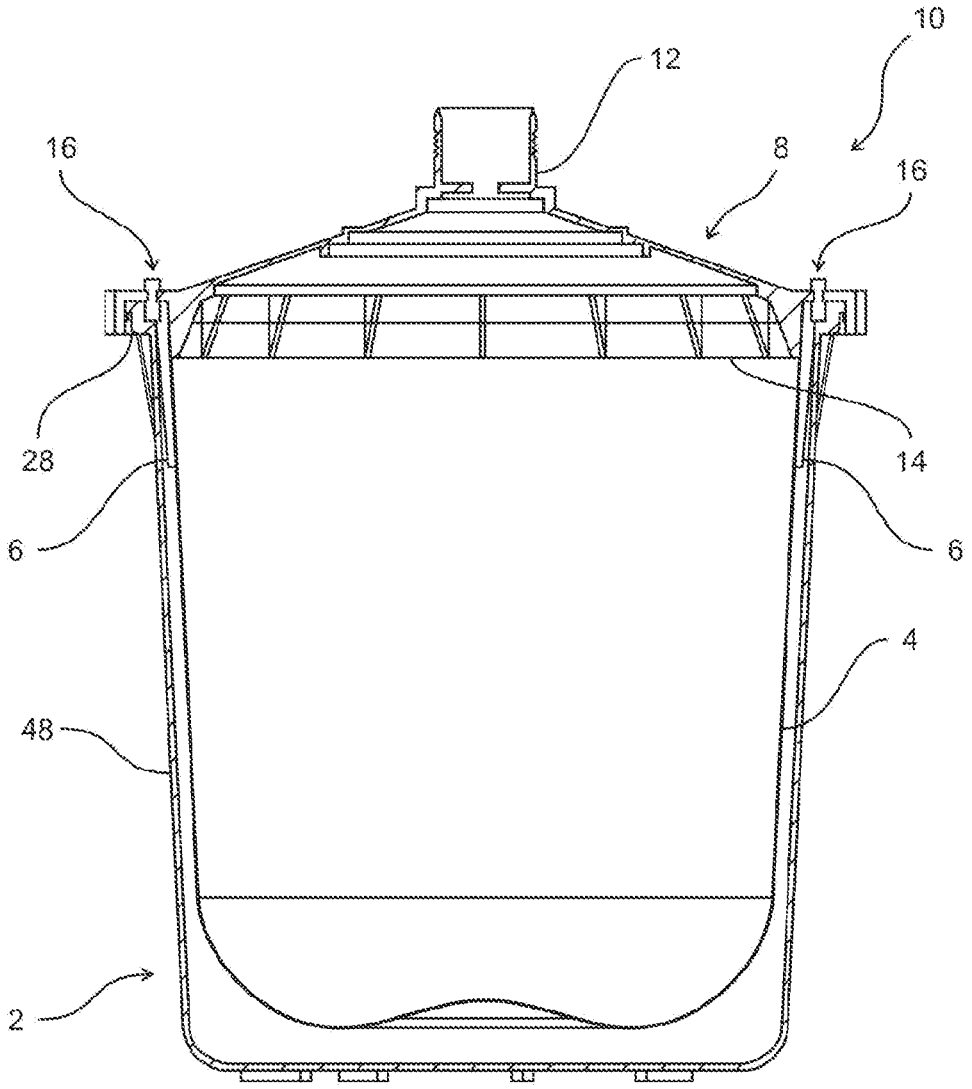
FIG. 1 is a cross sectional view of an assembled paint can assembly.

FIG. 1 is a cross sectional view of an assembled paint can assembly 10. The assembly includes a receptacle 2, a liner bag 4, a mounting ring 6, and a removable lid 8. The liner 4 is inserted into the receptacle 2 and paint is poured into the liner 4. The lid 8 has a paint outlet 12 for attachment of a hose that may have a spray paint nozzle at the end. The lid 8 has a flange 14 that inserts within the reservoir of the receptacle 2 and seals in the contents of the liner 4. The liner 4 is prevented from falling into the receptacle 2 by placing the liner 4 over protrusions 16 that extend upward from the mounting ring 6.

The receptacle 2 is made of a relatively stiff material, such as metal or certain plastics, and provides structural stability to the assembly 10. The receptacle 2 is open at one end and can be cylindrical in shape. The receptacle 2 may include an opening on its bottom or sidewall 48 to allow atmospheric pressure to equalize between the inside and outside of the receptacle 2. The receptacle 2 has an upper rim 28 that is substantially perpendicular to the cylindrical side wall 48 of the receptacle 2.

Figure 2:
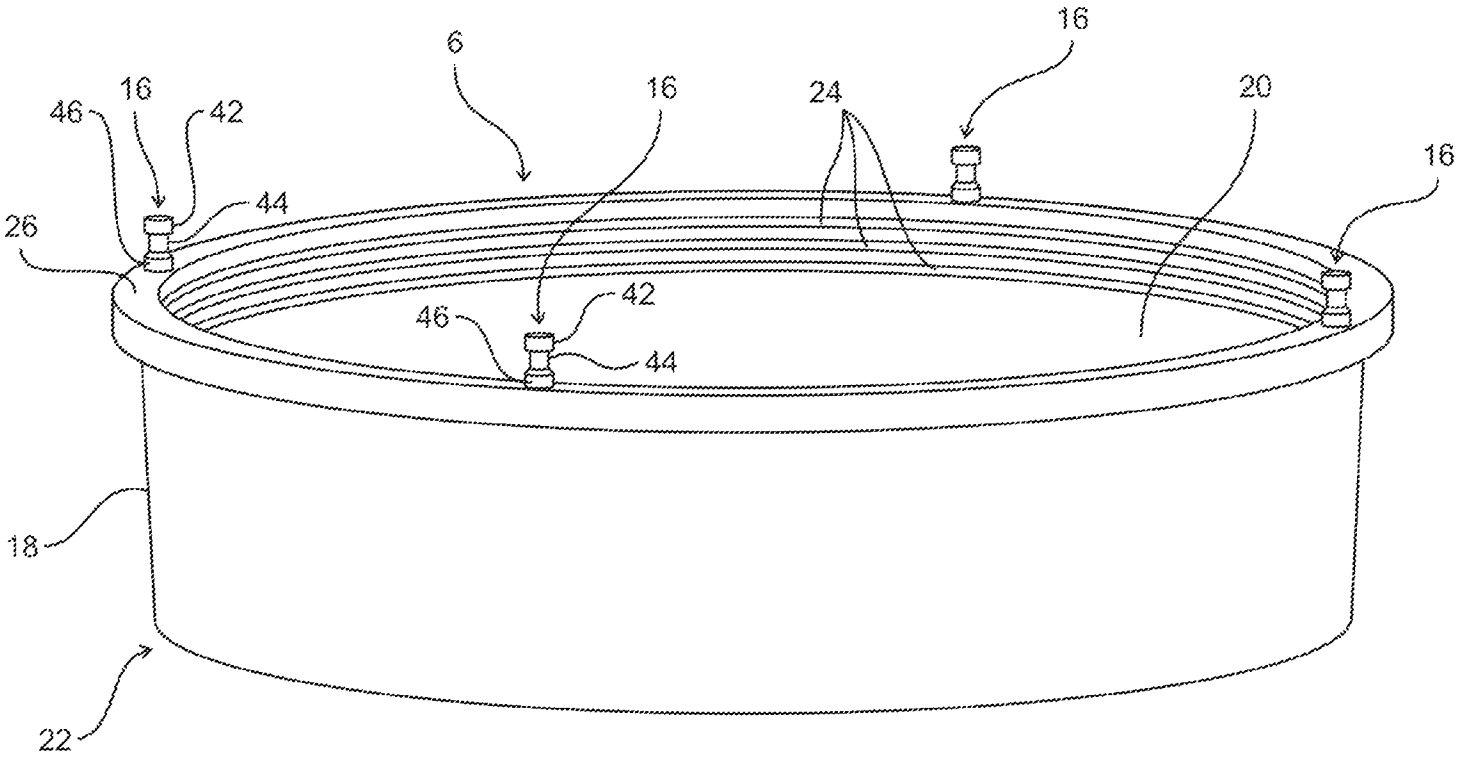
FIG. 2 is a perspective view of a mounting ring used in the paint can assembly.
Figure 3:
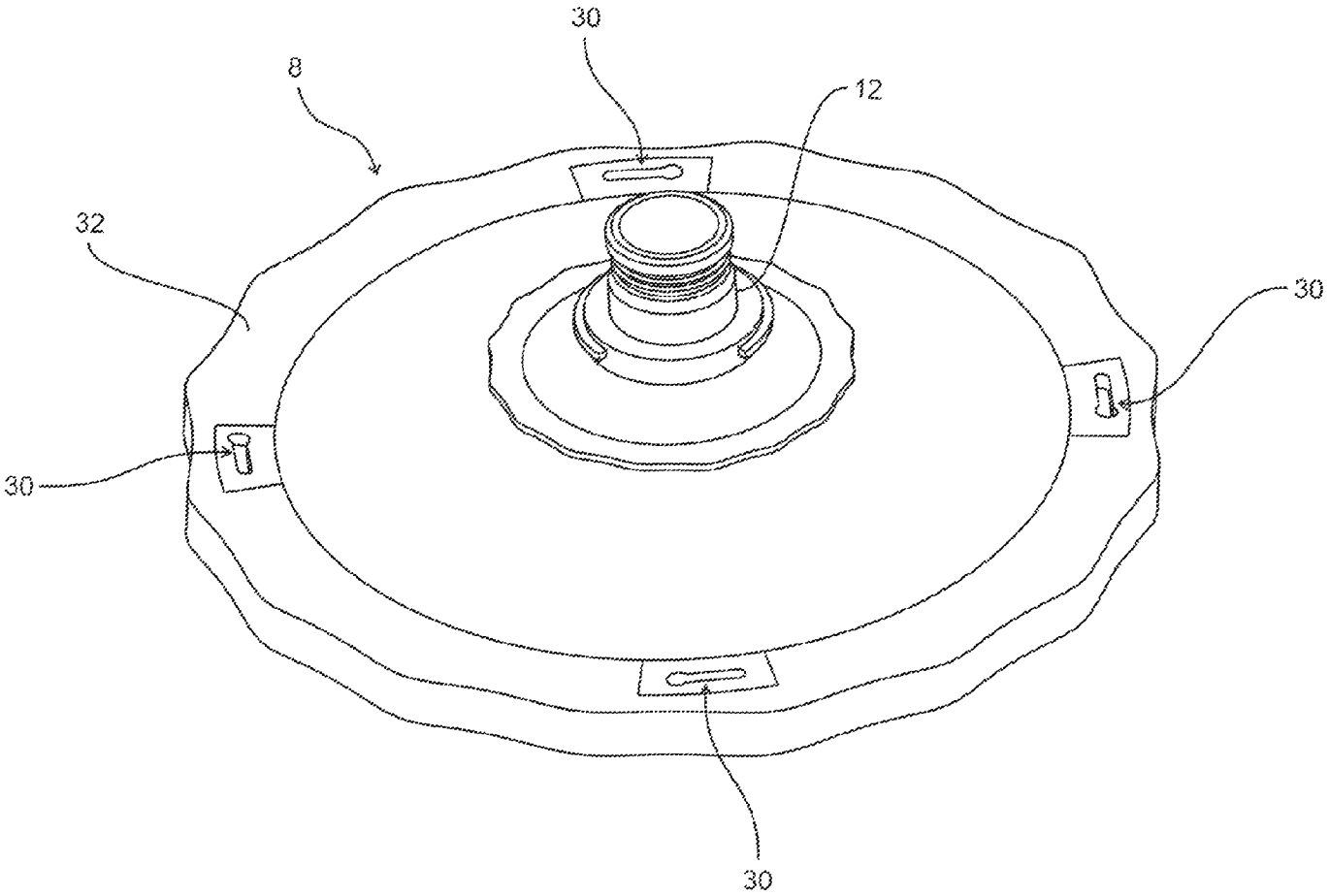
FIG. 3 is a perspective view of a removable lid that attaches to the mounting ring.

FIGS. 2 and 3 are perspective views that show the lid 8 lockably engaged with the mounting ring 6. The mounting ring 6 has a peripheral flange 22 that is substantially cylindrically shaped to fit within the cylindrically shaped receptacle 2. The mounting ring 6 has an open top and open bottom so that a liner bag 4 can be easily placed inside of the mounting ring 6 and receptacle 2. When assembled, the outer surface 18 of the mounting ring 6 is adjacent to the inner surface of the receptacle 2. The inner surface 20 of the mounting ring 6 has one or more threaded recesses 24 near the top of the mounting ring 6 so that the lid 8 can be mated with the mounting ring 6. The mounting ring 6 has an upper lip 26 that is substantially perpendicular to the flange 18, and in its assembled state, the upper lip 26 of the mounting ring rests over the upper rim 28 of the receptacle 2, which allows the mounting ring 6 to stay positioned near the top of the receptacle 2. Projecting from the upper lip 26 of the mounting ring are a plurality of projections or pins 16. The embodiment shown has four projections 16 that are evenly spaced, but any number of projections 16 spaced in a different arrangement can work in other embodiments. These projections 16 enable the lid 8 to lock onto the mounting ring 6 by fitting the projections 16 through slots 30 on the lid 8. To engage and couple the mounting ring 6 to the lid 8, the user places each projection 16 through a corresponding aligned slot 30 located on the lip 32 of the lid 8. The projections 16 and slots 30 are shaped so that when the lid 8 is rotated, the projections 16 shift to a region of the slot 30 having a narrower width. This configuration prevents the lid 8 from inadvertently decoupling or disengaging from the mounting ring 6.

Figure 4:
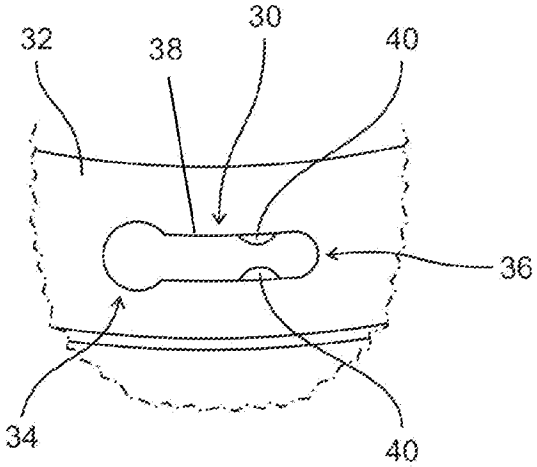
FIG. 4 is top view of the slot on the removable lid of FIG. 3.

FIG. 4 depicts one embodiment of the shape of the slots 30 that lockably engage the projections 16. The slots are located on the rim 32 of the lid 8. Each slot 30 has a first end 34, a second end 36, and a mid-section 38. The first end 34 has a width greater than the width of the second end 36. The different widths within each individual slot 30 are to accommodate a projection 16 that varies in width at different regions of the projection 16. The regions of the projection 16 include: a top region 42, a mid region 44 adjacent to the top region 42, and a base 46 adjacent to the middle region 44. The base 46 is attached, and may be integral with the lip 26 of the mounting ring 6. The top region 42 is generally cylindrically shaped and has a larger diameter than the middle 44, and is also generally cylindrical in shape. The top region 42 is sized only to be able to fit through the slot at the first end 34 and not fit through the slot at the second end 36. Therefore, in order to lockably engage the lid 8 with the mounting ring 6, the projections 16 are first passed through the slot 30 at the first end 34. The lid 8 is then rotated so that each projection 16 moves laterally through the mid section 38 to the second end 36 of the slot 30. Since the second end 36 of the slot 30 is smaller than the top region 42 of the protrusion 16, the lid 8 cannot be decoupled from the mounting ring 6 because the top region 42 of the projection 16 cannot pass vertically through the smaller second end 36 of the slot 30. Instead, once the lid 8 is rotated and is lockably engaged to the mounting ring 6 after rotation, the lid 8 can only disengage from the mounting ring 6 when the user rotates the lid 8 in the reverse direction so that the projections 16 can pass through the larger first end 34 of the slot.

In a preferred embodiment, the top region 42 of each projection 16 is approximately 3 mm in diameter, the middle region 44 is about 1.8 mm in diameter, and the base 46 is about 2.8 mm in diameter. In order for the projections 16 to fit within the slot 30 in this embodiment, then first end 34 of the slot 30 is substantially circular in shape and approximately 3 mm in diameter, the mid section 38 and second end 36 have a width of approximately 1.8 mm. In this preferred embodiment, the slot 30 is defined has having an arc that starts at 0 degrees and terminates at 8 degrees.

An additional feature that prevents the projection 16 from inadvertently moving from the second end 36 to the first end 34 of the slot 30, are protuberances 40 on opposites sides of the mid-section 38. These protuberances 40 jut into the central region of the midsection 38 of the slot 30 and reduce the width of the mid-section 38. The width of the midsection 38 at the protuberances 40 is sized to be approximately the width of the middle region 44 of each projection 16, or slightly smaller. The projections 16 are prevented from inadvertently shifting back to the larger first end 34 of the slot 30 by having the width of the slot 30 approximately the same size, or slightly smaller, than the middle region 44. Only light torque provided by the user is required to shift the projections 16 past the protuberances 40, so that the lid 8 can be locked or disengaged from the mounting ring 6.

Figure 5:
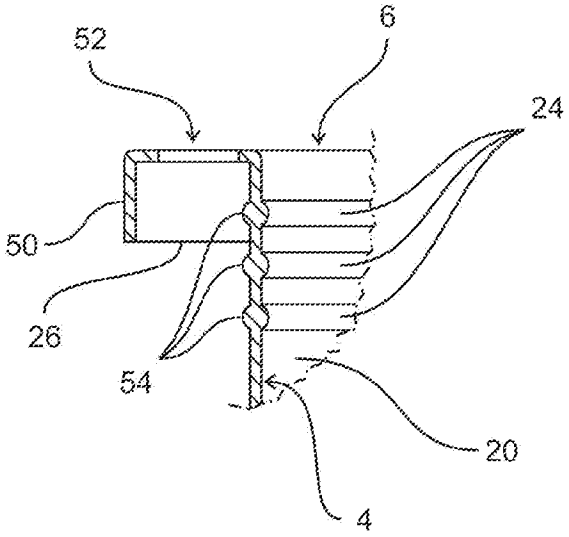
FIG. 5 is a cross sectional view of a receptacle liner bag disposed within the mounting ring.

FIG. 5 illustrates a disposable liner bag 4 for insertion into the receptacle 2. The liner 4 is closed at one end and open at the other end. The liner 4 may be made from a thin polymeric material so that the liner 4 can collapse as liquid is removed from the liner 4, forming a partial vacuum at the top of the liner 4. The liner 4 may also be stiff enough so that the liner can hold its shape while empty or filled. The liner may have a lip 50 at the top, and below the lip 50 are one or more liner holes 52. The liner holes 52 are arranged along the periphery of the liner 50 so that when the liner 4 is placed inside of the mounting ring 6, the liner holes 52 align with the projections 16. In a preferred embodiment, the holes 52 are approximately 3 mm in diameter so that the projections 16 (also about 3 mm at its largest diameter) barely fit through the holes 52, thereby reducing the space where paint could seep between the liner 4 and projections 16. The lip 50 of the liner 4 rests over the lip 36 of the mounting ring 6, and the diameter of the liner 4 has a diameter approximately the same as the diameter of the mounting ring 6 so that the liner 4 and the inner surface 20 of the mounting ring lay against each other when the liner 4 is disposed within the mounting ring 6. When the lid 8 is placed on top of the mounting ring 6 and locked into position by rotating the lid 8, the liner 4 is also locked into position since the projections 16 hold the liner 4 in place. The lid 8 is pressed against the liner 4, which seals any contents in the liner within the assembly 10.

The lid 8 is further secured to the receptacle 2 and further seals the liner to the inner surface of the mounting ring 6 by the presence of threaded recesses 24 in the mounting ring 6. The threaded recesses 24 not only help to lock the lid to the mounting ring 6, but provide a space for the liner 4 to fit within when the lid 8 and mounting ring 6 are coupled together. In one embodiment, an additional feature of the liner 4 is the presence of a plurality of bulges 54 below the liner bag holes 52. These bulges 54 are sized and shaped to correspond with the threaded recesses 24 so that each bulge 54 can be located within a recess 24. The bulges 54 fill in the spaces of the recesses 24 when the lid and mounting ring 6 are engaged with each other. Without these bulges 52, there is a greater chance that the paint could seep 6 between the lid 8 and mounting ring 6.

The assembly 10 may be coupled with various types of spray nozzles, such as gravity freed or suction feed spray nozzles, with the outlet 12 of the lid 8 connected to an inlet of a spray nozzle by an adapter.

To assemble the parts of the assembly 10, the user first places the liner 4 inside the mounting ring 6, and places the holes 52 of the liner 4 over the projections 16. Next, the liner 4 and mounting ring 6 are placed within the receptacle 2. The liner bag 4 is filled with paint or other liquid. The lid is then placed over the projections 16 of the mounting ring 6 through the first end 34 of the slot 30. The lid 8 is rotated so that the projections 16 slide to the second end of the slot 38, which locks the lid 8 to the mounting ring 6 and receptacle 2. The steps are reversed to disassembly the parts of the paint can assembly 10.

The foregoing description of the embodiments of the present invention has been presented for the purposes of illustration and description. It is not intended to be exhaustive or to limit the invention to the precise form disclosed. Many modifications and variations are possible in light of the above teachings. For example, although the above description has been described as being a four-piece assembly, additional pieces may be added without detracting from the invention. Additional liners or containers may be added to protect the inner walls of receptacle. These additional liners or containers may be rigid or disposable, and allow the user place the liners or containers within the receptacle described above, or paint can receptacles described known receptacles, such the receptacle described in U.S. Pat. No. 8,127,963 to Gerson, fully incorporated herein by reference in its entirety.

The numerical values presented above are only for illustration purposes and should not be understood as limiting the invention to the precise numbers. It is intended that the scope of the present invention not be limited by this detailed description, but by the claims and the equivalents to the claims appended hereto.

We claim:

1. A paint can assembly comprising:

a) a receptacle having an upper rim and an open top;

b) a mounting ring having i) a peripheral flange insertable into the receptacle, and ii) an upper lip adapted to be set on top of said upper rim, said upper lip having a plurality of projections extending substantially perpendicular from said upper lip, c) a receptacle liner bag disposed within said receptacle, said receptacle liner bag made of a deformable material and having i) a top region having an open end, ii) a plurality of holes along a periphery of said top region, said plurality of holes arranged in alignment with said plurality of projections on said upper lip of said mounting ring;

d) a removable lid for covering the open end of liner bag, the removable lid including a flange having plurality of slots in alignment with said plurality of projections on said mounting ring, wherein said peripheral flange of said mounting ring has an inner surface and an outer surface, said inner surface having threaded recesses for mating said removable lid, said upper lip of said mounting ring is substantially perpendicular to said peripheral flange; and, wherein said receptacle liner bag comprises a plurality of bulges along a periphery of the receptacle liner bag, said plurality of bulges each sized to fit within said threaded recesses of said mounting ring;

whereby said removable lid prevents liquid from spilling from the assembly by securing said removable lid to said mounting ring by inserting said projections of said mounting ring through said slots of said removable lid thereby sealing said receptacle liner bag and covering said receptacle and said mounting ring.

2. The paint can assembly of claim 1, wherein the receptacle, mounting ring, liner and lid form a liquid tight seal when assembled.

3. The paint can assembly of claim 1, wherein each of said plurality of projections has a top region and a middle region, said top region having a width greater than a width of said middle region.

4. The paint can assembly of claim 3, wherein each of said plurality of projections further comprises a base, said base adjacent to said middle region, said base having a width greater than said middle region of said projection.

5. The paint can assembly of claim 1 wherein each said plurality of holes of said receptacle liner bag are substantially equally spaced along the periphery of said receptacle liner bag, and wherein each of said plurality of slots are substantially equally spaced along said flange, and wherein each of said plurality of projections are substantially equally spaced along said mounting ring.

6. The pain can assembly of claim 1 wherein each of said plurality of slots has a first end and a second end, said first end having a first width, and said end having a second width shorter than said first width, whereby said lid is prevented from being uncoupled from said mounting ring, said plurality of projections traverse through said second end of said plurality of slots.

7. The paint can assembly of claim 6, wherein each of plurality of slots further comprise a protuberance between said first and second end of said slot, whereby said protuberance restricts said projections from inadvertently shifting from said second end to said first end of slot.

8. A paint can assembly, comprising:

a) a receptacle having an upper rim and an open top;

b) a mounting ring having i) a peripheral flange insertable into the receptacle, and ii) an upper lip adapted to be set on top of said upper rim, said upper lip having a plurality of projections extending substantially perpendicular from said upper lip, c) a receptacle liner bag disposed within said receptacle, said receptacle liner bag made of a deformable material and having i) a top region having an open end, ii) a plurality of holes along a periphery of said top region, said plurality of holes arranged in alignment with said plurality of projections on said upper lip of said mounting ring, said plurality of projections project through said plurality of holes;

d) a removable lid for covering the open end of liner bag, the removable lid including a flange having plurality of slots in alignment with said plurality projections of said mounting ring, wherein said peripheral flange of said mounting ring has an inner surface and an outer surface, said inner surface having threaded recesses for coupling said removable lid to said mounting ring, said upper lip of said mounting ring substantially perpendicular to said peripheral flange;

wherein said plurality of projections each have a top region and a middle region, said top region having a width greater than said middle region;

wherein each of said plurality of projections further comprises a base, said base adjacent to said middle region, said base having a width greater than said middle region of said projections;

wherein each said plurality of holes of said receptacle liner bag are substantially equally spaced along the periphery of said receptacle liner bag, and wherein each of said plurality of slots are substantially equally spaced along said flange, and wherein each of said plurality of projections are substantially equally spaced along said mounting ring;

wherein each of said plurality of slots has a first end and a second end, said first end having a first width, and said end having a second width shorter than said first width, whereby said lid is prevented from being uncoupled from said mounting ring, and said plurality of projections traverse through said second end of said plurality of slots;

wherein said receptacle liner bag further comprises a plurality of bulges along a periphery of the receptacle liner bag, and wherein each of said plurality of bulges are sized to fit within said threaded recesses of said mounting ring;

wherein each of plurality of slots further comprise a protuberance between said first and second end of said slot, whereby said protuberance restricts said plurality of projections from inadvertently sliding from said second end to said first end of said slot.

* * * * *